US006039354A

United States Patent [19]

Mangler

[11] Patent Number: 6,039,354

[45] Date of Patent: Mar. 21, 2000

[54] INDEX SHEET HAVING A DUAL-SIDE DIRECTLY MACHINE PRINTABLE INDEX TAB PORTION AND METHOD OF MAKING THE SAME

[75] Inventor: Robert J. Mangler, Partridge, Ill.

[73] Assignee: ACCO Brands, Inc., Lincolnshire, Ill.

[21] Appl. No.: 08/612,137

[22] Filed: Mar. 7, 1996

[51] Int. Cl.[7] ..... B42D 1/00

[52] U.S. Cl. ..... 281/38; 402/79; 283/36; 283/37

[58] Field of Search ..... 283/36–42, 62; 402/79; 281/38, 32; 226/91–92; D19/1, 2, 33

[56] References Cited

U.S. PATENT DOCUMENTS

| | | | |
|---|---|---|---|
| 5,144 | 11/1872 | Partridge . | |
| 529,477 | 11/1894 | Brown . | |
| 561,888 | 6/1896 | Hon . | |
| 612,078 | 10/1898 | Wickham . | |
| 764,701 | 7/1904 | Ayres . | |
| 783,365 | 2/1905 | Coleman . | |
| 843,416 | 2/1907 | Ohashi . | |
| 1,048,577 | 12/1912 | Pardoe, Jr. . | |
| 1,058,118 | 4/1913 | Wardy . | |
| 1,142,644 | 6/1915 | Vesterling . | |
| 1,151,475 | 8/1915 | Kingsley et al. . | |
| 1,428,102 | 9/1922 | Kelly . | |
| 1,429,436 | 9/1922 | Kelly . | |
| 1,501,234 | 7/1924 | Rand . | |
| 1,559,129 | 10/1925 | Pimm . | |
| 1,777,499 | 10/1930 | Kupfer . | |
| 1,861,259 | 5/1932 | Brasseur . | |
| 1,922,213 | 8/1933 | Middleton . | |
| 1,924,755 | 8/1933 | Rubin . | |
| 2,001,651 | 5/1935 | Bingham | 129/24 |
| 2,300,623 | 11/1942 | Hornung . | |
| 2,345,793 | 4/1944 | Chapel . | |
| 2,502,785 | 4/1950 | Gottschalk . | |
| 2,576,272 | 11/1951 | Adelman | 40/102 |
| 3,454,451 | 7/1969 | Buckholz | 156/513 |
| 3,770,943 | 11/1973 | Sill . | |
| 3,970,397 | 7/1976 | Armstrong | 402/79 |
| 4,043,573 | 8/1977 | Griffin . | |
| 4,046,615 | 9/1977 | Jansen . | |
| 4,127,690 | 11/1978 | Schleifenbaum et al. . | |
| 4,184,699 | 1/1980 | Lowe, Jr. | 281/41 |
| 4,240,848 | 12/1980 | Barber | 156/64 |

(List continued on next page.)

FOREIGN PATENT DOCUMENTS

| | | | |
|---|---|---|---|
| 92696 | 4/1990 | Japan . | |
| 219435 | 3/1968 | Sweden . | |
| 23716 | 10/1897 | United Kingdom . | |
| 23716 | 8/1898 | United Kingdom | 283/42 |
| WO 93/04943 | 3/1993 | WIPO . | |

OTHER PUBLICATIONS

ACCO USA, Inc., Wheeling, Illinois, *Perma Day–Timer*and Fact Book, pp. 29–34© 1995.

ACCO USA, Inc., Wheeling, Illinois, *Multidex Index*Product Brochure –Quick Reference Index System, ©1992.

Duralon, Product Brochure –excerpt.

JBC Design Group, Inc. Torrance, California, *Extend–A–Tab*™ Product Brochure –Dual–Insertable Tabs, ©1995.

*Primary Examiner*—Willmon Fridie, Jr.

*Attorney, Agent, or Firm*—Pennie & Edmonds LLP

[57] ABSTRACT

An index sheet or divider which may be accommodated by and directly printed upon by a conventional machine printer. The index sheet includes a main body portion and a foldable index tab portion. The index tab portion is transformable into a configuration allowing the index sheet to controlledly pass through a printer. After printing, the index tab portion is transformable into another configuration allowing it to stand out, identify, separate, or otherwise distinguish documents or items with which one or more index sheets are kept. When completed, the index tab portion has back-to-back printable surfaces.

12 Claims, 3 Drawing Sheets

U.S. PATENT DOCUMENTS 4,422,672 12/1983 Levi .
4,430,015 2/1984 Nerlinger .
4,431,325 2/1984 Colby .
4,446,183 5/1984 Savagian .
4,447,481 5/1984 Holmberg et al. .
4,448,558 5/1984 Weingarten .
4,479,733 10/1984 Segal .
4,523,775 6/1985 Reist ..... 283/36
4,529,227 7/1985 Fields .
4,560,600 12/1985 Yellin et al. ..... 428/43
4,568,108 3/1986 Simpson .
4,636,179 1/1987 Gentile et al. .
4,643,452 2/1987 Chang .
4,643,455 2/1987 North et al. .
4,662,700 5/1987 Block ..... 402/80 R
4,704,317 11/1987 Hickenbotham et al. .
4,748,758 6/1988 Gaston ..... 40/359
4,773,676 9/1988 Showering .
4,779,897 10/1988 Schall et al. .
4,784,508 11/1988 Shannon ..... 402/79
4,802,692 2/1989 Stryd .
4,803,795 2/1989 Questel et al. .
4,810,544 3/1989 Hickman ..... 428/40
4,822,017 4/1989 Griesmyer .
4,844,508 7/1989 Choi ..... 281/15.1
4,865,477 9/1989 George .
4,884,826 12/1989 Slagsvol .
4,884,827 12/1989 Kelley ..... 283/81
4,887,925 12/1989 Groswith, III et al. .
4,900,018 2/1991 Best et al. .
4,910,066 3/1990 Foisie .
4,911,777 3/1990 Truc et al. .
4,923,111 5/1990 Down .
4,952,091 8/1990 Sirko .
4,952,433 8/1990 Tezuka et al. .
4,961,666 10/1990 Pitts et al. .
4,962,603 10/1990 Kao et al. ..... 40/641
4,972,952 11/1990 Reisender .
5,016,370 5/1991 Rhian et al. .
5,033,899 7/1991 Pitts et al. .
5,040,216 8/1991 Policht ..... 281/46
5,044,807 9/1991 Meservy et al. ..... 402/80 L
5,076,490 12/1991 Dulin ..... 229/92.8
5,125,561 6/1992 Idstein ..... 229/1.5 R
5,135,261 8/1992 Cusack et al. .
5,174,606 12/1992 Hure ..... 281/45
5,180,461 1/1993 Widmann .
5,187,888 2/1993 O'Brien et al. .
5,219,183 6/1993 McKillip ..... 283/62
5,228,388 7/1993 Brown ..... 101/226
5,299,879 4/1994 Burrow .
5,316,344 5/1994 Popat et al. ..... 283/81
5,333,908 8/1994 Dorney et al. ..... 283/38
5,340,427 8/1994 Cusack et al. ..... 156/268
5,389,414 2/1995 Popat ..... 428/40
5,401,058 3/1995 Holmberg .
5,407,234 4/1995 Rettker et al. ..... 283/62
5,407,718 4/1995 Popat et al. ..... 428/42
5,447,336 9/1995 Deighton ..... 283/115
5,468,085 11/1995 Kline ..... 402/79
5,503,435 4/1996 Kline ..... 283/67
5,524,998 6/1996 Schwatrz .
5,558,454 9/1996 Owen .
5,571,587 11/1996 Bishop et al. .
5,599,128 2/1997 Steiner .
5,601,313 2/1997 Konkol et al. .
5,662,976 9/1997 Popat et al. .
5,743,566 4/1998 Hunter et al. .
5,782,494 7/1998 Crandall et al. .
5,792,297 8/1998 Hunter et al. .

INDEX SHEET HAVING A DUAL-SIDE DIRECTLY MACHINE PRINTABLE INDEX TAB PORTION AND METHOD OF MAKING THE SAME

FIELD OF THE INVENTION

The present invention relates generally to index sheets and, more particularly, to bindable index sheets which are directly printable upon, using machines, such as computer operated printers.

BACKGROUND ART

Index tabs for quick identification and selection of information from looseleaf or hardbound binders are a common feature of nearly every well-organized office. Typically, these tabs are provided as markings on certain sheets or pages of binders, books, notebooks, or other sheet material. In order to facilitate scanning and selection of pages, the index tabs are typically staggered or spaced, along two orthogonal planes. For example, the tab mounted on the side of a subsequent index sheet is positioned just far enough below the tab mounted on the side of the immediately preceding index sheet that the identifying text or characters or symbols appearing on both tabs can be seen when the binder is closed and viewed from the adjacent side. Uses for such index tabs range from simple referencing to presentations.

In general, indexing tabs are made in one of two ways. The tabs may be integrally formed as protrusions of the sheets themselves as shown, for example, in U.S. Pat. No. 4,184,699 issued to Lowe on Jan. 22, 1980. Alternatively, the tabs may comprise separate elements which are connected to the index sheets as shown, for example in U.S. Pat. No. 4,962,603 issued to Kao et al. on Oct. 16, 1990; U.S. Pat. No. 5,135,261 issued to Cusack et al. on Aug. 4, 1992; U.S. Pat. No. 5,340,427 issued to Cusack et al. on Aug. 23, 1994; and U.S. Pat. No. 5,389,414 issued to Popat on Feb. 14, 1995.

As Kao et al. indicates, forming index tabs as integral protrusions of the index sheet has been disadvantageous, since it has been difficult to machine print identifying text on the tabs. For example, it has been impractical to insert the entire index sheet into a typewriter in order to type text onto the protruding tab. It has also been difficult or impossible to feed index sheets directly through common office printers, such as laser or inkjet printers, without encountering jamming, feed size limit, or uneven printing problems.

It is desirable to print index sheets on laser or inkjet printers due to the great flexibility of what can be printed as well as the high print quality provided by such printers or the like. However, such printers require the sheet stock to be uniformly dimensioned, at least widthwise, according to standard sizes in order to be accommodated by the standard sized feeding tray or platform of such printers. Otherwise, the sheet stock will either tend to jam such printers or not even fit into such printers. Index sheets, having protruding tabs on the top or leading side first drawn into the printer, can also jam or stray from the correct feed path. Moreover, the sheet stock must be strong enough to withstand the stresses imposed on the sheets by the feeding mechanisms and pressure rollers, and must provide a uniformly smooth surface that will properly take up the toner. Because of these requirements, conventional index sheets having nonuniform widths due to protruding index tabs have been poorly suited for use in laser or inkjet printers.

This drawback is all the more pronounced when the tabs are to be used to mark the pages of a hardbound or softbound book. As a result, the identifying text is usually either handwritten onto the tabs, or else the text is printed on separate adhesive labels which are then placed on the corresponding tabs.

The present invention is directed to overcoming one or more of the problems as set forth above.

SUMMARY OF THE INVENTION

In one aspect of the present invention, a directly machine printable index sheet is disclosed. The index sheet comprises a main body portion having a peripheral border and an index tab portion integrally formed with the main body portion and extending outwardly from the border. The index tab portion includes a first panel connected to the main body portion, a first line segment positioned between the first panel and the main body portion, a second panel connected to either the first panel or the main body portion, and a second line segment positioned between the second panel and said either the first panel or the main body portion.

In another aspect of the present invention, there is disclosed a method of directly printing upon an index sheet using a printing machine. The method comprises the steps of folding a first panel along a first line segment so that first and second panels of an index tab portion are positioned within a border of a main body portion. The method further includes the steps of directly printing upon a printable surface of at least one panel using a printing machine and unfolding the first panel along the first line segment so that the first panel extends outwardly beyond the border. The method further includes the steps of either folding or separating the second panel along the second line segment and laminating the second panel against the first panel.

The index sheet of the present invention is provided with a foldable index tab portion which allows the index sheet to pass in a controlled fashion through a printing machine such as a computer printer. After printing, the index tab portion is transformable into a configuration allowing it to stand out, identify, separate, or otherwise distinguish documents or items with which one or more index sheets are kept. When completed, the index tab portion extends from the main body portion of the index sheet and has a pair of visible back-to-back printable surfaces.

DETAILED DESCRIPTION OF THE INVENTION

Figure 1:
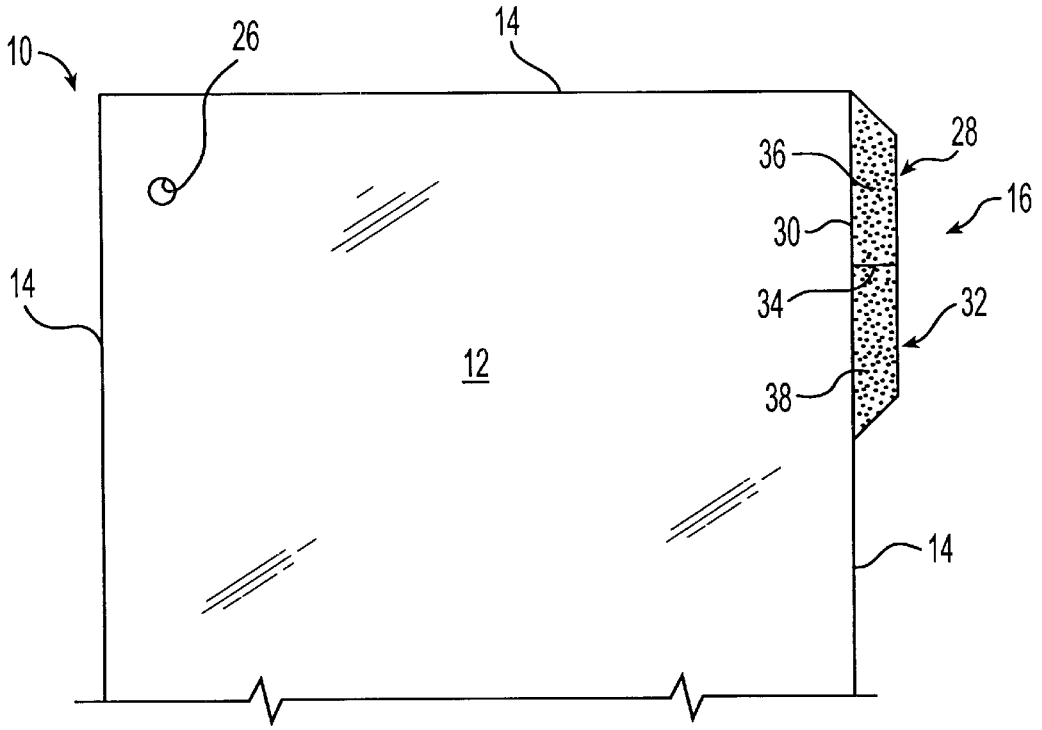
FIG. 1 is a diagrammatic partial top plan view of a first embodiment of an index sheet of the present invention wherein a printable blank index tab portion is shown unfolded relative to a main body portion.

Referring to FIGS. 1–6, wherein similar reference characters designate similar elements or features throughout the Figs., there is shown two embodiments of a bindable index sheet or device 10, 10' of the present invention.

The index sheet 10,10' includes a generally planar main body portion 12, having a four-sided peripheral border 14, and an index tab portion 16 integrally formed with the main body portion and extending outwardly from the border. Preferably, the border 14 is substantially rectangular in shape and includes opposed top and bottom sides and opposed first and second lateral sides. The border 14 has preselected dimensions which allow the index sheet 10,10' to pass through a standard size printing machine such as a laser or inkjet printer. For example, the preselected dimensions may be a uniform width of about 8½ inches and a uniform length of about 11 inches. Alternatively, the dimensions may be A4 size, 8½ inches by 14 inches, or some other standard or desired dimensions.

The index sheet 10,10' may be formed, for example, of a substantially pure paper based medium or a composite material such as a paper/plastic laminate which is die cut to the desired shape and dimensions. Preferably, the main body portion 12 defines at least one and, more preferably, a plurality of bindable holes 26. Each hole 26 may be optionally reinforced by a separate or unitary covering (not shown) formed of a reinforcing material selected from mylar or the like.

In the first embodiment of the index sheet 10 shown in FIGS. 1–4, the index tab portion 16 includes a first panel 28 connected to the main body portion 12, a first crease or fold or score line segment 30 positioned between the first panel 28 and the main body portion 12, a second panel 32 connected to the first panel 28, and a second crease or fold or score line segment 34 positioned between the second panel 32 and the first panel 28.

Figure 3:
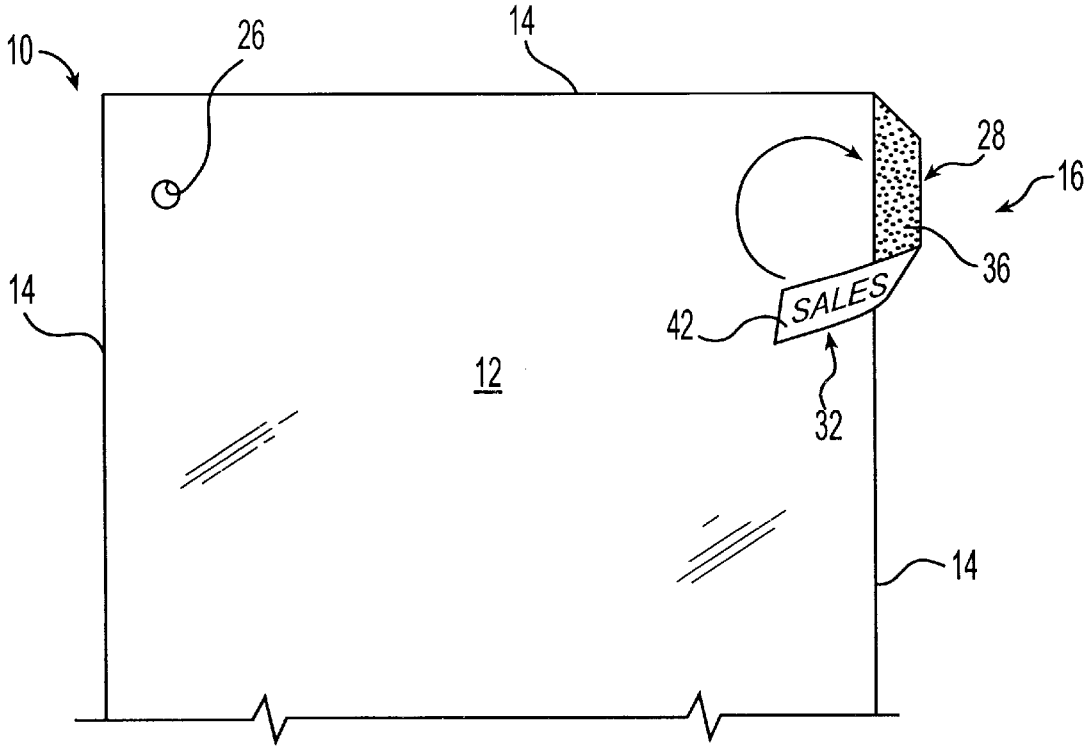
FIG. 3 is a view similar to FIG. 2 but after the index tab portion is printed upon and while the index tab portion is in the process of being further folded.
Figure 4:
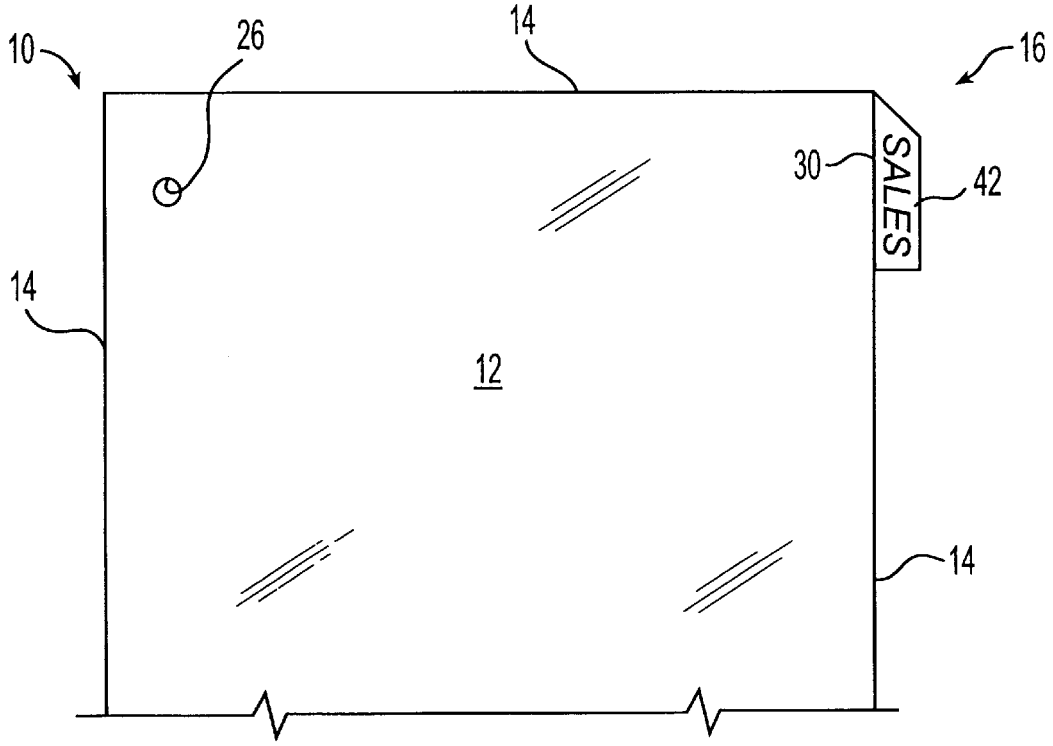
FIG. 4 is a view similar to FIG. 3 but after the index tab portion has been printed upon and fully assembled.

Preferably, the first and second panels 28,32 are mirror images of one another in size and shape. The first and second panels 28,32 are transformable or foldable between first, second, and third positions. In the first position shown in FIG. 1, both panels 28,32 are unfolded and extend outwardly from the main body portion 12 beyond the border 14. In the second position shown in FIG. 2, the first panel 28 is inwardly folded along the first crease line segment 30 and both panels 28,32 are positioned within the border 14 against the main body portion 12. In the third position, the first panel 28 is unfolded (as shown in FIGS. 3–4) and extends outwardly from the main body portion 12 beyond the border 14. Moreover, the second panel 32 is folded along the second crease line segment 34 and permanently laminated or bonded against the first panel 28 as shown in FIG. 4.

In the first embodiment of the index sheet 10 shown in FIGS. 1–4, the second panel 32 is positioned adjacent to the border 14 of the main body portion 12. Moreover, the second panel 32 is preferably separated from the border 14 of the main body portion 12. The first crease line segment 30 is substantially collinear with a portion of the border 14. The first and second crease line segments 30,34 are substantially perpendicular to one another. Alternatively, the first panel 28 may be positioned between the main body portion 12 and the second panel 32. In this alternative embodiment, the first and second crease line segments 30,34 are substantially parallel to one another.

The first and second panels 28,32 each have an adhesive surface 36,38 and a printable surface 40,42. The adhesive surfaces 36,38 have an adhesive thereon and contact the main body portion 12 when the panels 28,32 are at their second position. Preferably, the adhesive is a low tack pressure-sensitive substance. The adhesive surfaces 36,38 contact one another when the panels 28,32 are at their third position.

Figure 2:
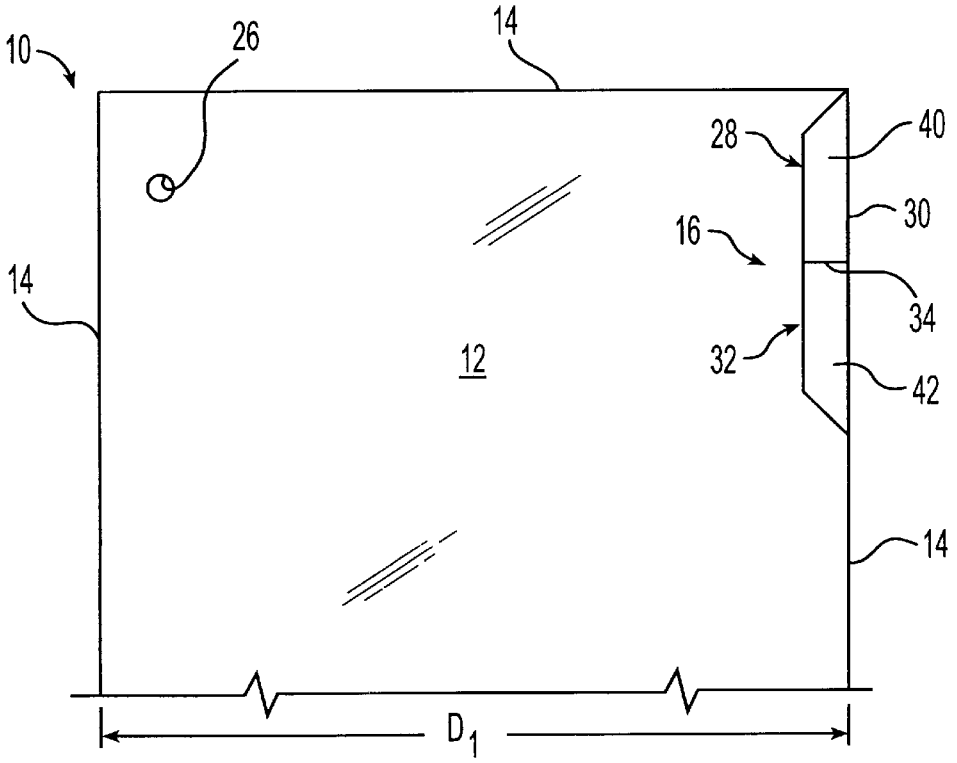
FIG. 2 is view similar to FIG. 1 but after the index tab portion is folded laterally against the main body portion.

As shown in FIG. 2, the blank printable surfaces 40,42 are visible over the main body portion 12 when the panels 28,32 are at their second position. As shown in FIG. 4, the printable surfaces 40,42 are exposed for viewing in opposite directions and are positioned back-to-back when the panels 28,32 are at their third position.

Figure 5:
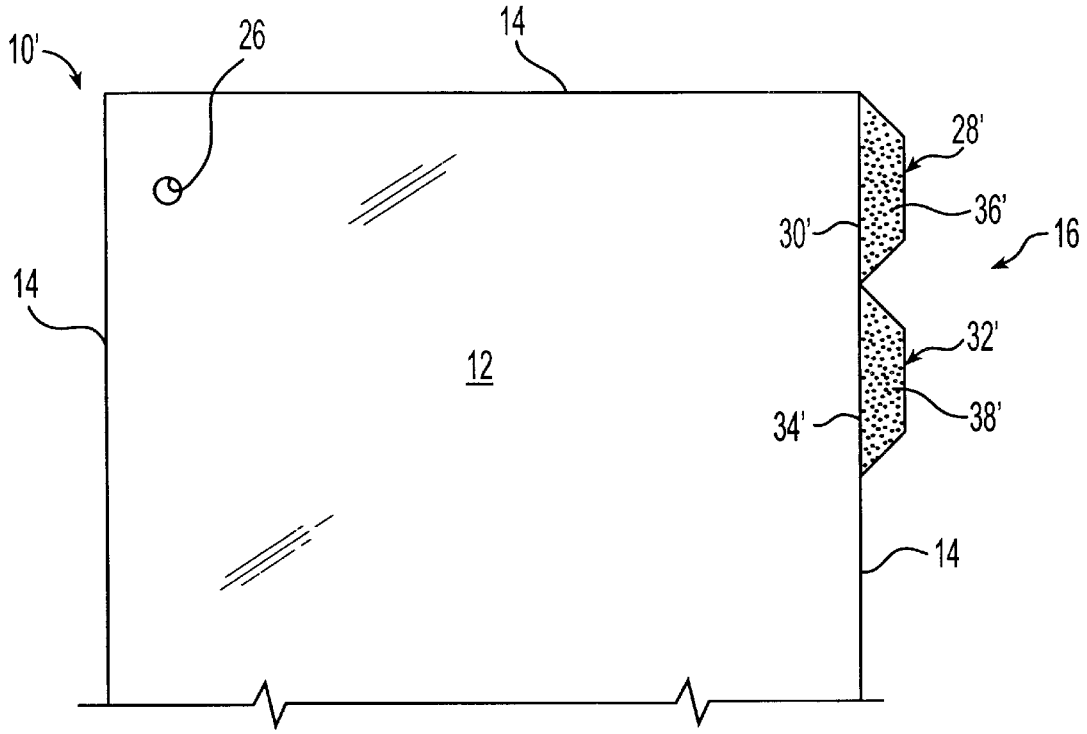
FIG. 5 is a view similar to FIG. 1 but showing a second embodiment of an index sheet of the present invention.
Figure 6:
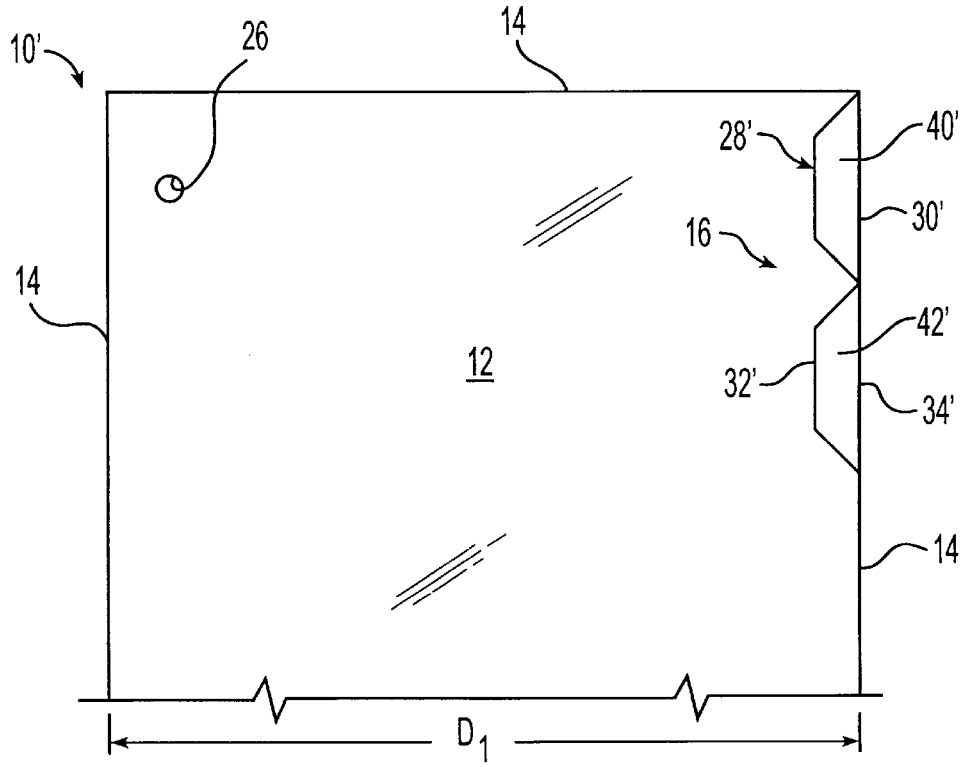
FIG. 6 is view similar to FIG. 5 but after the index tab portion is folded laterally against the main body portion.

In the second embodiment of the index sheet 10' shown in FIGS. 5–6, the second panel 32' is connected to the main body portion 12 and the second crease line segment 34' is positioned between the second panel 32' and the main body portion 12. Preferably, the first and second panels 28',32' of the index tab portion 16' are adjacent to one another. Moreover, the first and second crease line segments 30',34' are substantially collinear with one another and with a portion of the border 14.

Preferably, the first and second panels 28',32' are mirror images of one another in size and shape. The first and second panels 28',32' are transformable or foldable between first, second, and third positions. In the first position shown in FIG. 5, both panels 28',32' are unfolded and extend outwardly from the main body portion 12 beyond the border 14. In the second position shown in FIG. 6, both panels 28',32' are inwardly folded along their respective crease line segments 30',34' and positioned within the border 14 against the main body portion 12. In the third position (not shown), the first panel 28' is unfolded and extends outwardly from the main body portion 12 beyond the border 14. The second panel 32' is separated or torn from the main body portion 12 along the second crease line segment 34' and permanently laminated or bonded against said the first panel 28'.

The first and second panels 28',32' each have an adhesive surface 36',38' and a printable surface 40',42'. The adhesive surfaces 36',38' have an adhesive thereon and contact the main body portion 12 when the panels 28',32' are at their second position. Preferably, the adhesive is a low tack pressure-sensitive substance. The adhesive surfaces 36',38' contact one another when the panels 28',32' are at their third position. The printable surfaces 40',42' are visible over the main body portion 12 when the panels 28',32' are at their second position. The printable surfaces 40',42' are exposed for viewing in opposite directions and are positioned back-to-back when the panels 28',32' are at their third position.

INDUSTRIAL APPLICABILITY

The index sheets of the present invention enables one to print directly on back-to-back surfaces 40,42 of the index tab portion 16, during a single pass, using commonly available laser or inkjet printers.

A method of making and directly printing upon the index sheet with a machine printer will now be described with respect to the embodiment of the index sheet 10 shown in FIGS. 1–4. The method comprises the steps of folding the first panel 28 along the first crease line segment 30 so that both panels 28,32 are positioned within the border 14 and against the main body portion 12. The method further includes the steps of feeding the index sheet 10 to a conventional printing machine (not shown) and directly printing upon a printable surface 40,42 of at least one panel 28,32 using the printing machine. With the index tab portion 16 folded into its second position shown in FIG. 2, the index sheet 10 has a uniform width $D_1$ which is advantageously equal to or smaller than the maximum feed width of the printer. Alternatively, if the index tab portion 16 is connected to the top side of the border 14, the inwardly folded index tab portion 16 at its second position advantageously presents a uniform leading edge which facilitates controlled feeding through the printer.

Preferably, printing is placed on both printable surfaces 40,42 so that when the panels 28,32 are laminated together as shown in FIG. 4, the printed indicia can be viewed in two opposite directions from back-to-back surfaces 40,42 of the index tab portion 16. Preferably, the software controlling the printing machine is programmed to ensure that printing indicia applied to either or both printable surfaces 40,42 is properly displayed or viewed when the subject method is completed. Next, the first panel 28 is unfolded along the first crease line segment 30 so that the first panel 28 extends outwardly from the main body portion 12 beyond the border 14. The method further includes the steps of folding the second panel 32 along the second crease line segment 34 and permanently laminating or bonding the second panel 32 against the first panel 28.

A method of making and directly printing upon the index sheet with a machine printer will now be described with respect to the embodiment of the index sheet 10' shown in FIGS. 5–6. The method comprises the steps of folding the first and second panels 28',32' along their respective crease line segments 30',34' so that both panels 28',32' are positioned within the border 14 and against the main body portion 12 as shown in FIG. 6. The method further includes the steps of feeding the index sheet 10' to a conventional printing machine (not shown) and directly printing upon a printable surface 40',42' of at least one panel 28',32' using the printing machine. With the index tab portion 16' folded into its second position shown in FIG. 6, the index sheet 10' has a uniform width $D_1$ which is advantageously equal to or smaller than the maximum feed width of the printer. Alternatively, if the index tab portion 16' is connected to the top side of the border 14, the inwardly folded index tab portion 16' at its second position advantageously presents a uniform leading edge which facilitates controlled feeding through the printer.

Preferably, printing is placed on both printable surfaces 40',42' so that when the panels 28',32' are laminated together, the printed indicia can be viewed in two opposite directions from the back-to-back surfaces 40',42' of the index tab portion 16'. Preferably, the software controlling the printing machine is programmed to ensure that printing indicia applied to either or both printable surfaces 40',42' is properly displayed or viewed when the subject method is completed. The method further includes the steps of unfolding the first panel 28' along the first crease line segment 30' so that the first panel 28' extends outwardly from the main body portion 12 beyond the border 14. The second panel 32' is separated or torn from the main body portion 12 along the second crease line segment 34' and permanently laminated or bonded against the first panel 28'.

Other aspects, objects, and advantages of this invention can be obtained from a study of the drawings, the disclosure, and the appended claims.

I claim:

1. An index sheet, comprising:

a main body portion having a peripheral border;

an index tab portion integrally formed with the main body portion and extending outwardly from the border, said index tab portion including a first panel connected to the main body portion, a first crease line segment positioned between the first panel and the main body portion, a second panel connected to said first panel, and a second crease line segment positioned between the second panel and the first panel for folding said second panel over onto said first panel with opposed surfaces of said first and second panels engaging each other, said opposed surfaces being secured to each other when said second panel is folded over onto said first panel.

2. The index sheet of claim 1, wherein said first and second panels are foldable between i) a first position at which both panels are unfolded and extend outwardly from the main body portion beyond said border; ii) a second position at which the first panel is inwardly folded along said first crease line segment and both panels are positioned within said border against the main body portion; and iii) a third position at which the first panel is unfolded and extends outwardly from the main body portion beyond said border and wherein said second panel is folded along said second crease line segment and laminated against said first panel.

3. The index sheet of claim 2, wherein said second panel is positioned adjacent to the border of the main body portion.

4. The index sheet of claim 3, wherein said second panel is separated from the border of the main body portion.

5. An index sheet, comprising:

a main body portion having a peripheral border;

an index tab portion integrally formed with the main body portion and extending outwardly from the border, said index tab portion including a first panel connected to the main body portion, a first crease line segment positioned between the first panel and the main body portion, a second panel connected to said first panel, and a second crease line segment positioned between the second panel and the first panel;

said first and second panels being foldable between i) a first position at which both panels are unfolded and extend outwardly from the main body portion beyond said border; ii) a second position at which the first panel is inwardly folded along said first crease line segment and both panels are positioned within said border against the main body portion; iii) a third position at which the first panel is unfolded and extends outwardly from the main body portion beyond said border and wherein said second panel is folded along said second crease line segment and laminated against said first panel;

said first and second panels each having an adhesive surface and a printable surface, said adhesive surfaces having an adhesive thereon and contacting the main body portion when said panels are at their second position, said adhesive surfaces contacting one another when the panels are at their third position, said printable surfaces being visible over the main body portion when the panels are at their second position, said printable surfaces being visible and positioned back-to-back when the panels are at their third position.

6. The index sheet of claim 5, wherein said adhesive is a low tack substance.

7. An index sheet, comprising:

a main body portion having a peripheral border;

an index tab portion integrally formed with the main body portion and extending outwardly from the border, said index tab portion including a first panel connected to the main body portion, a first crease line segment positioned between the first panel and the main body portion, a second panel connected to said first panel, and a second crease line segment positioned between the second panel and the first panel; and said first and second crease line segments being substantially perpendicular to one another.

8. An index sheet, comprising:

a main body portion having a peripheral border;

an index tab portion integrally formed with the main body portion and extending outwardly from the border, said index tab portion including a first panel connected directly to the main body portion, a first crease line segment positioned between the first panel and the main body portion, a second panel connected directly to said main body portion, and a second crease line segment positioned between the second panel and the main body portion and separating said second panel from said main body portion by, wherein said first and second panels are foldable between i) a first position at which both panels are unfolded and extend outwardly from the main body portion beyond said border; ii) a second position at which both panels are inwardly folded along their respective crease line segments and positioned within said border against the main body portion; and iii) a third position at which the first panel is unfolded and extends outwardly from the main body portion beyond said border wherein said second panel is separated from the main body portion along said second crease line segment and laminated against said first panel.

9. An index sheet, comprising:

a main body portion having a peripheral border;

an index tab portion integrally formed with the main body portion and extending outwardly from the border, said index tab portion including a first panel connected to the main body portion, a first crease line segment positioned between the first panel and the main body portion, a second panel connected to said main body portion, and a second crease line segment positioned between the second panel and the main body portion, wherein said first and second panels are foldable between i) a first position at which both panels are unfolded and extend outwardly from the main body portion beyond said border; ii) a second position at which both panels are inwardly folded along their respective crease line segments and positioned within said border against the main body portion; and iii) a third position at which the first panel is unfolded and extends outwardly from the main body portion beyond said border wherein said second panel is separated from the main body portion along said second crease line segment and laminated against said first panel; and said first and second panels each having an adhesive surface and a printable surface, said adhesive surfaces having an adhesive thereon and contacting the main body portion when said panels are at their second position, said adhesive surfaces contacting one another when the panels are at their third position, said printable surfaces being visible over the main body portion when the panels are at their second position, said printable surfaces being visible and positioned back-to-back when the panels are at their third position.

10. An index sheet, comprising:

a main body portion having a peripheral border;

an index tab portion integrally formed with the main body portion and extending outwardly from the border, said index tab portion including a first panel connected to the main body portion, a first crease line segment positioned between the first panel and the main body portion, a second panel connected to said main body portion, and a second crease line segment positioned between the second panel and the main body portion, wherein said first and second crease line segments are substantially collinear with one another;

said second panels being removable from said main body portion; and at least one of said panels having an adhesive on one surface thereof for laminating the panels together when said second panel is removed from said main body portion.

11. A method of making and directly machine printing upon an index sheet including a main body portion having a peripheral border and an index tab portion integrally formed with the main body portion and extending outwardly from the border, said index tab portion including a first panel connected to the main body portion, a first crease line segment positioned between the first panel and the main body portion, a second panel connected to the first panel, and a second crease line segment positioned between the second panel and the first panel, said method comprising the steps of:

folding the first panel along the first crease line segment so that both panels are positioned within the border and against the main body portion;

feeding the index sheet to a printing machine;

directly printing upon a printable surface of at least one panel using the printing machine;

unfolding the first panel along the first crease line segment so that the first panel extends outwardly from the main body portion beyond said border;

folding the second panel along the second crease line segment; and laminating the second panel against the first panel.

12. A method of making and directly machine printing upon an index sheet including a main body portion having a peripheral border and an index tab portion integrally formed with the main body portion and extending outwardly from the border, said index tab portion including a first panel connected to the main body portion, a first crease line segment positioned between the first panel and the main body portion, a second panel connected to the main body portion, and a second crease line segment positioned between the second panel and the main body portion, said method comprising the steps of:

folding the first and second panels along their respective crease line segments so that both panels are positioned within the border and against the main body portion;

feeding the index sheet to a printing machine;

directly printing upon a printable surface of at least one panel using the printing machine;

unfolding the first panel along the first crease line segment so that the first panel extends outwardly from the main body portion beyond said border;

separating the second panel from the main body portion along the second crease line segment; and laminating the second panel against the first panel.

* * * * *